US011710428B2

(12) United States Patent
Lamberti

(10) Patent No.: US 11,710,428 B2
(45) Date of Patent: Jul. 25, 2023

(54) ILLUMINATED DECORATIVE PANEL

(71) Applicant: TECNOGRAFICA S.p.A., Castellarano (IT)

(72) Inventor: Paolo Lamberti, Castellarano (IT)

(73) Assignee: TECNOGRAFICA S.p.A., Castellarano (IT)

( * ) Notice: Subject to any disclaimer, the term of this patent is extended or adjusted under 35 U.S.C. 154(b) by 84 days.

(21) Appl. No.: 17/427,058

(22) PCT Filed: Dec. 13, 2019

(86) PCT No.: PCT/IB2019/060769
§ 371 (c)(1),
(2) Date: Jul. 29, 2021

(87) PCT Pub. No.: WO2020/161539
PCT Pub. Date: Aug. 13, 2020

(65) Prior Publication Data

US 2022/0122494 A1 Apr. 21, 2022

(30) Foreign Application Priority Data

Feb. 5, 2019 (IT) ..... 102019000001671

(51) Int. Cl.
*G09F 13/18* (2006.01)
*G09F 13/22* (2006.01)

(52) U.S. Cl.
CPC ..... *G09F 13/18* (2013.01); *G09F 13/22* (2013.01); *G09F 2013/1836* (2013.01); *G09F 2013/1845* (2013.01); *G09F 2013/222* (2013.01)

(58) Field of Classification Search
CPC .. G09F 13/18; G09F 13/22; G09F 2013/1836; G09F 2013/1845; G09F 2013/222; G09F 2013/1854; G09F 2013/184
See application file for complete search history.

(56) References Cited

U.S. PATENT DOCUMENTS 2,982,039 A * 5/1961 Hardesty ..... G09F 13/22 40/544
9,375,103 B1 * 6/2016 Hoppaugh ..... A47G 1/0622
2004/0095741 A1 * 5/2004 Chen ..... G02B 6/0081 362/604
2007/0070640 A1 * 3/2007 Sexton ..... B60R 13/10 362/497
2009/0100727 A1 * 4/2009 Chen ..... G09F 13/20 40/546

(Continued)

FOREIGN PATENT DOCUMENTS

FR 2 991 488 A1 12/2013
IT MI20 111 513 A1 2/2013

(Continued)

*Primary Examiner* — Gary C Hoge
(74) *Attorney, Agent, or Firm* — Aslan Law, P.C.

(57) ABSTRACT

An illuminated decorative panel comprises a slab composed at least partly of substantially transparent material, a decorative element associated with the slab, lighting device/unit/component/structure of the slab comprising at least one emitting device of at least one light wave, wherein the slab comprises at least one housing compartment of the emitting device formed along at least one stretch of at least one side of the slab.

21 Claims, 6 Drawing Sheets

(56) References Cited

U.S. PATENT DOCUMENTS

| | | | | |
|---|---|---|---|---|
| 2010/0046198 | A1* | 2/2010 | Hoffman | G09F 13/22 445/24 |
| 2011/0051395 | A1* | 3/2011 | Field | G09F 13/18 362/257 |
| 2011/0069512 | A1* | 3/2011 | Horst | G02B 6/0021 362/613 |
| 2011/0167690 | A1* | 7/2011 | Bjarnason | G02B 6/0021 362/296.05 |
| 2012/0036750 | A1* | 2/2012 | Ryul | G09F 13/18 29/460 |
| 2012/0260546 | A1* | 10/2012 | Hu | G09F 13/22 40/582 |
| 2012/0304513 | A1* | 12/2012 | Gorelick | G09F 13/18 40/606.19 |
| 2015/0192262 | A1* | 7/2015 | Champagne | F21V 21/008 40/714 |
| 2016/0111029 | A1* | 4/2016 | Hermes, III | G09F 13/22 40/544 |
| 2018/0253999 | A1* | 9/2018 | Auyeung | F21V 29/89 |
| 2019/0272779 | A1* | 9/2019 | Gamble | B60Q 1/0005 |

FOREIGN PATENT DOCUMENTS

| | | | |
|---|---|---|---|
| JP | H10 282911 | A | 10/1998 |
| WO | WO 2006/104339 | A1 | 10/2006 |
| WO | WO 2013/177842 | A1 | 12/2013 |

* cited by examiner

Fig.4
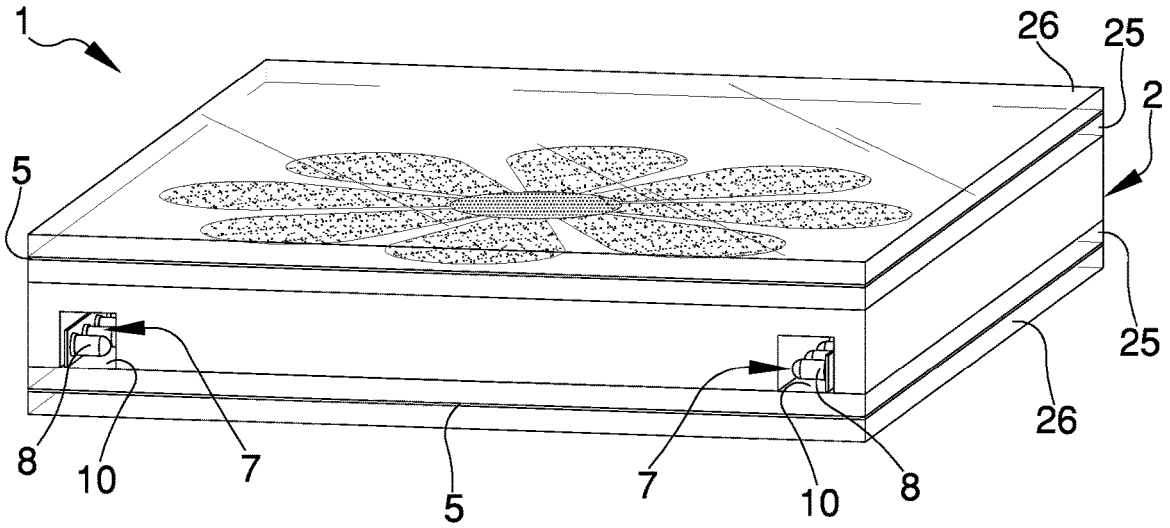
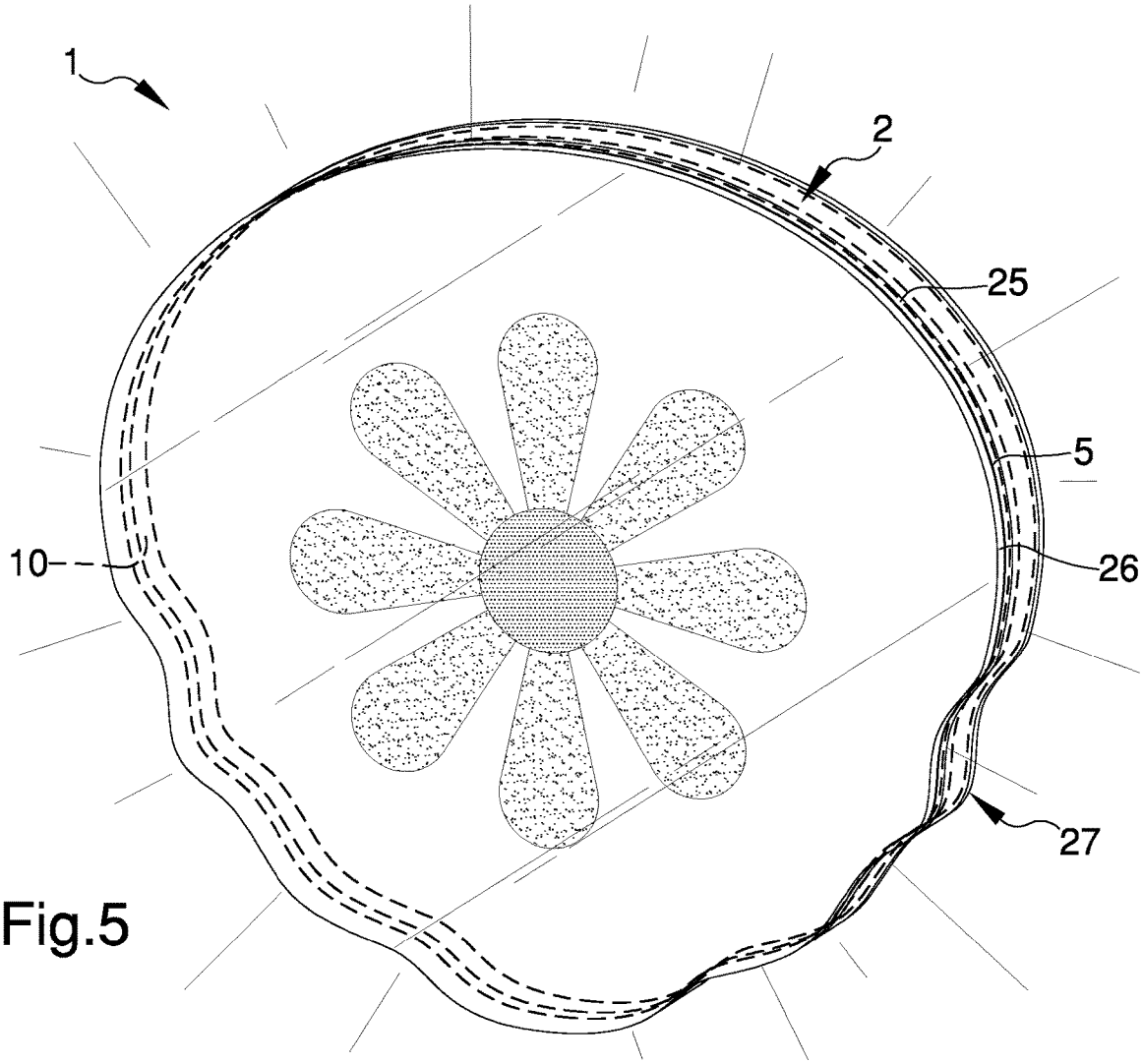
Fig.5

Fig.10
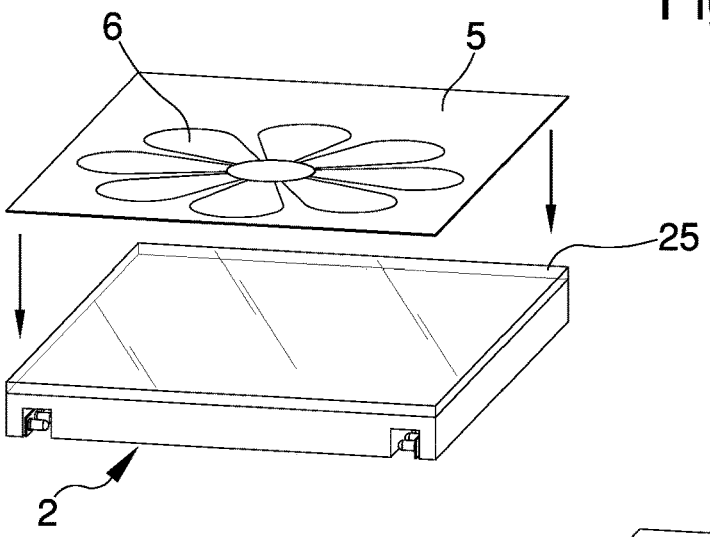
Fig.11
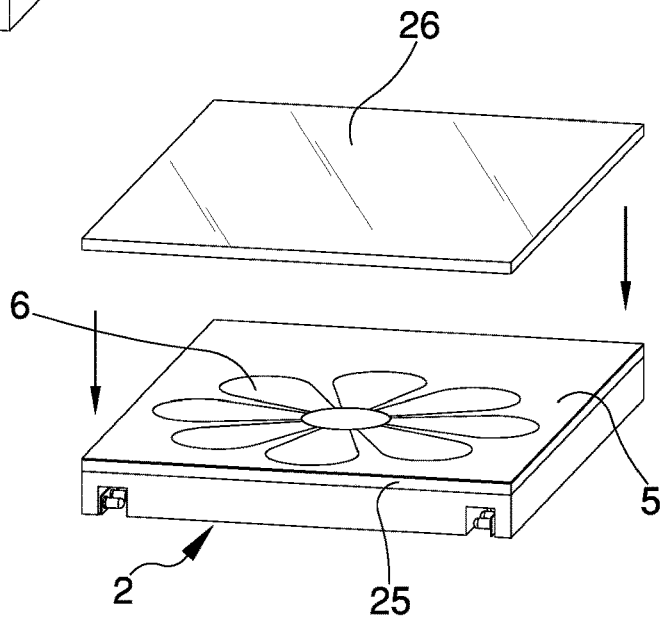
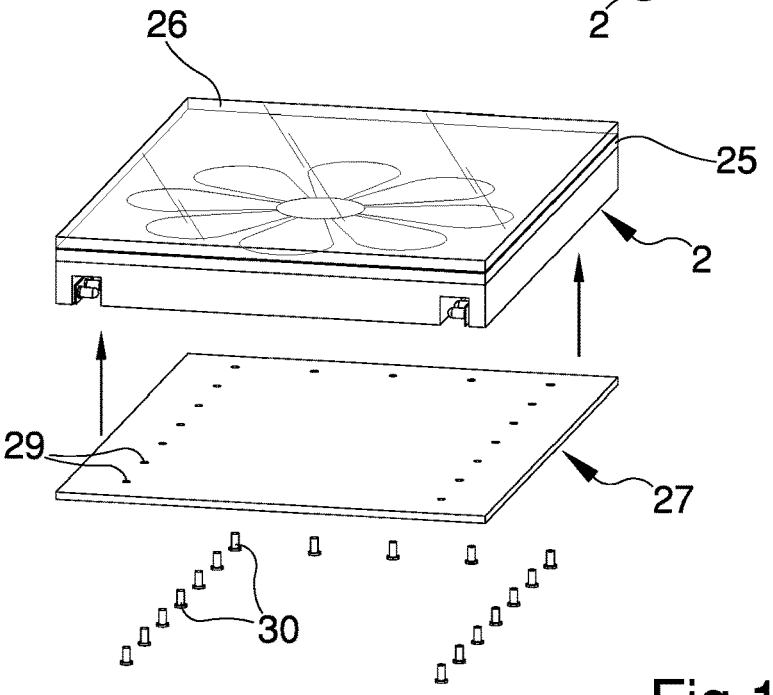
Fig.12

ILLUMINATED DECORATIVE PANEL

CROSS-REFERENCE TO RELATED APPLICATIONS

This application claims priority to IT Patent Application No. 102019000001671 filed on Feb. 5, 2019, and this application claims priority to and is a 371 of international PCT Application No. PCT/IB2019/060769 filed on Dec. 13, 2019, the entire contents of which are hereby incorporated by reference.

TECHNICAL FIELD

This invention relates to an illuminated decorative panel.

BACKGROUND ART

The use is well known of illuminated decorative panels which can be installed on the inner walls of buildings in order to obtain particular aesthetic effects. Furthermore, it is well known that illuminated decorative panels are used on the access doors of a room in order to improve its aesthetics.

The use is also well known of illuminated decorative panels as dividing elements between two adjacent rooms or as replacing or additional elements of furniture doors, in particular cabinets.

Known types of illuminated decorative panels usually comprise a slab made of transparent polymer material (usually Plexiglas) and lighting devices (usually of the LED type), which are positioned in a housing compartment associated with the slab.

Specifically, the slab comprises a first face, on which a decorative sheet is applied, and a second face opposite the first face.

The housing compartment is associated behind the slab, at the point where the second face is located, so that the light produced by the lighting devices passes through the slab moving from the second face to the first face, reaching and illuminating the decorative sheet.

The illuminated decorative panels of known type do however have some drawbacks.

The housing compartment of the lighting devices is often cumbersome and, being associated with the slab, makes the thickness of the illuminated decorative panel often too high to fall within the aesthetic standards required by the market.

Moreover, the particular structure of the decorative panels of known type does not allow obtaining an even diffusion of light on the whole area of the decorative panel itself, in particular along the edges. This inevitably leads to an aesthetic effect that is not always effective, with shadow areas along the edges of the panel. This uneven diffusion of light is even more evident when several panels are placed side by side to decorate a large surface.

Additionally, the high thickness of the illuminated decorative panels complicates the installation processes of the illuminated decorative panels themselves.

Furthermore, the manufacturing phase of the housing compartment and the subsequent phase of assembly of the same to the slab require processing times which are often long and can negatively affect the manufacturing costs of the illuminated decorative panels of known type and, consequently, the market price of the same.

Furthermore, dust, humidity and dirt in general can penetrate between the housing compartment and the slab and can reach the lighting devices, damaging them or affecting their lighting power; this way, the frequency of maintenance and/or replacement activities of the lighting devices themselves can increase. Additionally, the aforementioned harmful agents can reduce the level of transparency of the slab, thus affecting the aesthetic appearance of the illuminated decorative panel itself.

DESCRIPTION OF THE INVENTION

The main aim of the present invention is to devise an illuminated decorative panel that has small overall dimensions.

Another object of the present invention is to devise an illuminated decorative panel that allows reducing the manufacturing times and costs.

Another object of the present invention is to devise an illuminated decorative panel that allows simplifying and speeding up the installation operations.

Another object of the present invention is to devise an illuminated decorative panel that allows reducing the infiltration of dust and/or humidity and/or other elements that can damage the illuminated decorative panel and/or affect the aesthetic properties thereof.

Another object of the present invention is to devise an illuminated decorative panel that allows overcoming the aforementioned drawbacks of the prior art in the ambit of a simple, rational, easy, effective to use and affordable solution.

The aforementioned objects are achieved by the present illuminated decorative panel having the characteristics of claim 1.

The aforementioned objects are also achieved by the present process for manufacturing an illuminated decorative panel having the characteristics of claim 19.

BRIEF DESCRIPTION OF THE DRAWINGS

Other characteristics and advantages of the present invention will be more evident from the description of some preferred, but not exclusive, embodiments of an illuminated decorative panel and of a process for manufacturing an illuminated decorative panel, illustrated by way of an indicative, yet non-limiting example, in the attached tables of drawing in which:

FIG. 4 is a partly broken cross-sectional view of a second embodiment of the illuminated decorative panel according to the invention;

FIG. 5 is an axonometric view of an additional possible embodiment of the illuminated decorative panel according to the invention;

FIGS. 6 to 12 are schematic representations of the process for manufacturing an illuminated decorative panel according to the invention.

EMBODIMENTS OF THE INVENTION

Figure 1:
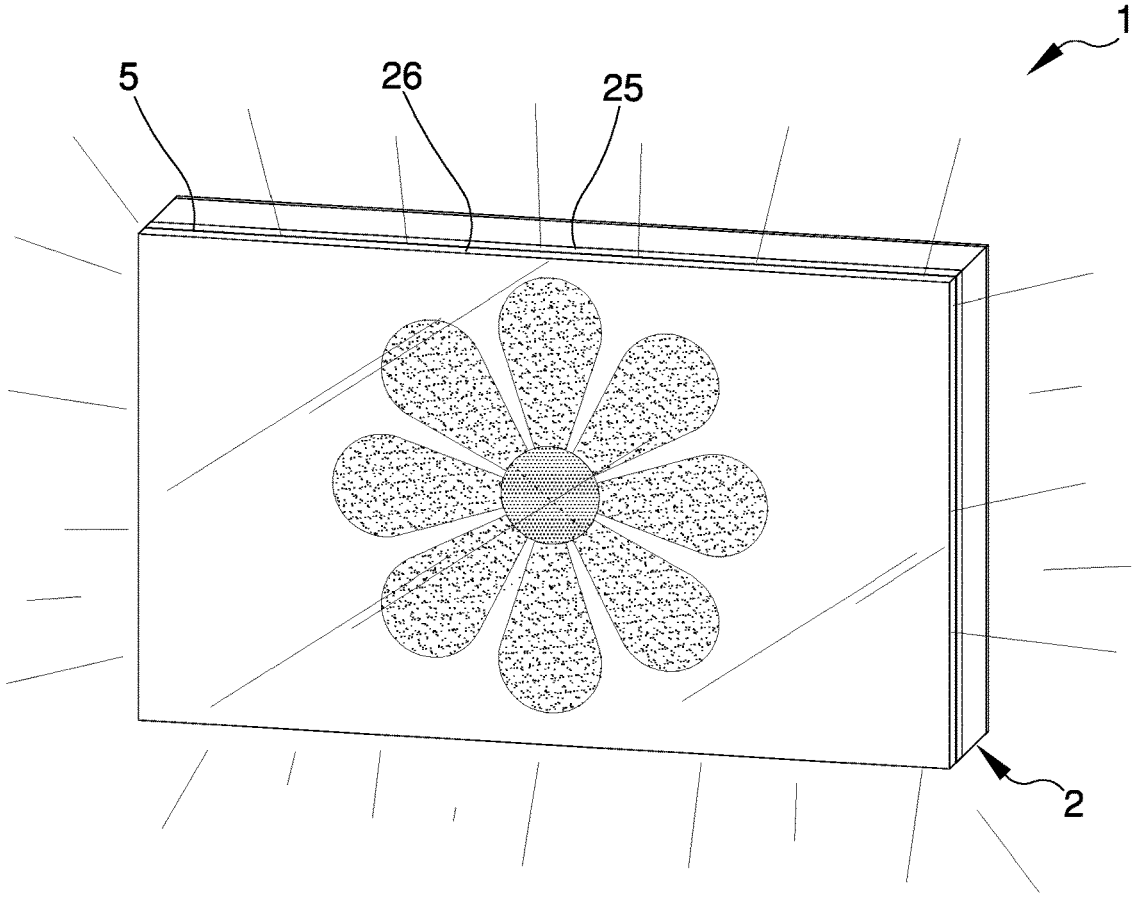
FIG. 1 is an axonometric view of a first embodiment of the illuminated decorative panel according to the invention.
Figure 2:
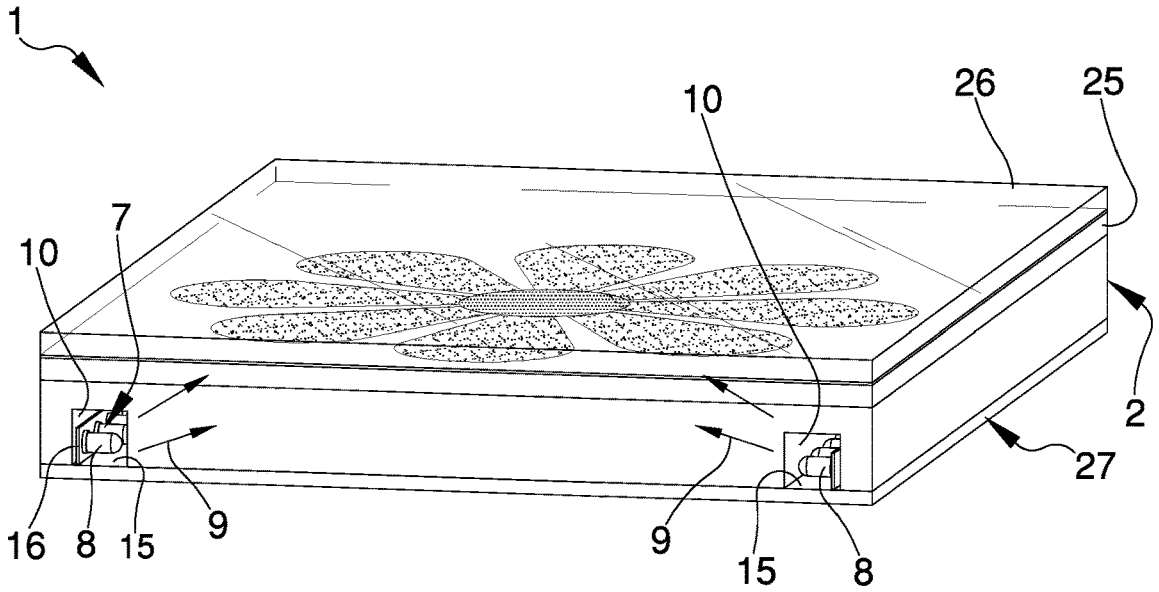
FIG. 2 is a partly broken cross-sectional view of the illuminated decorative panel in FIG. 1.
Figure 3:
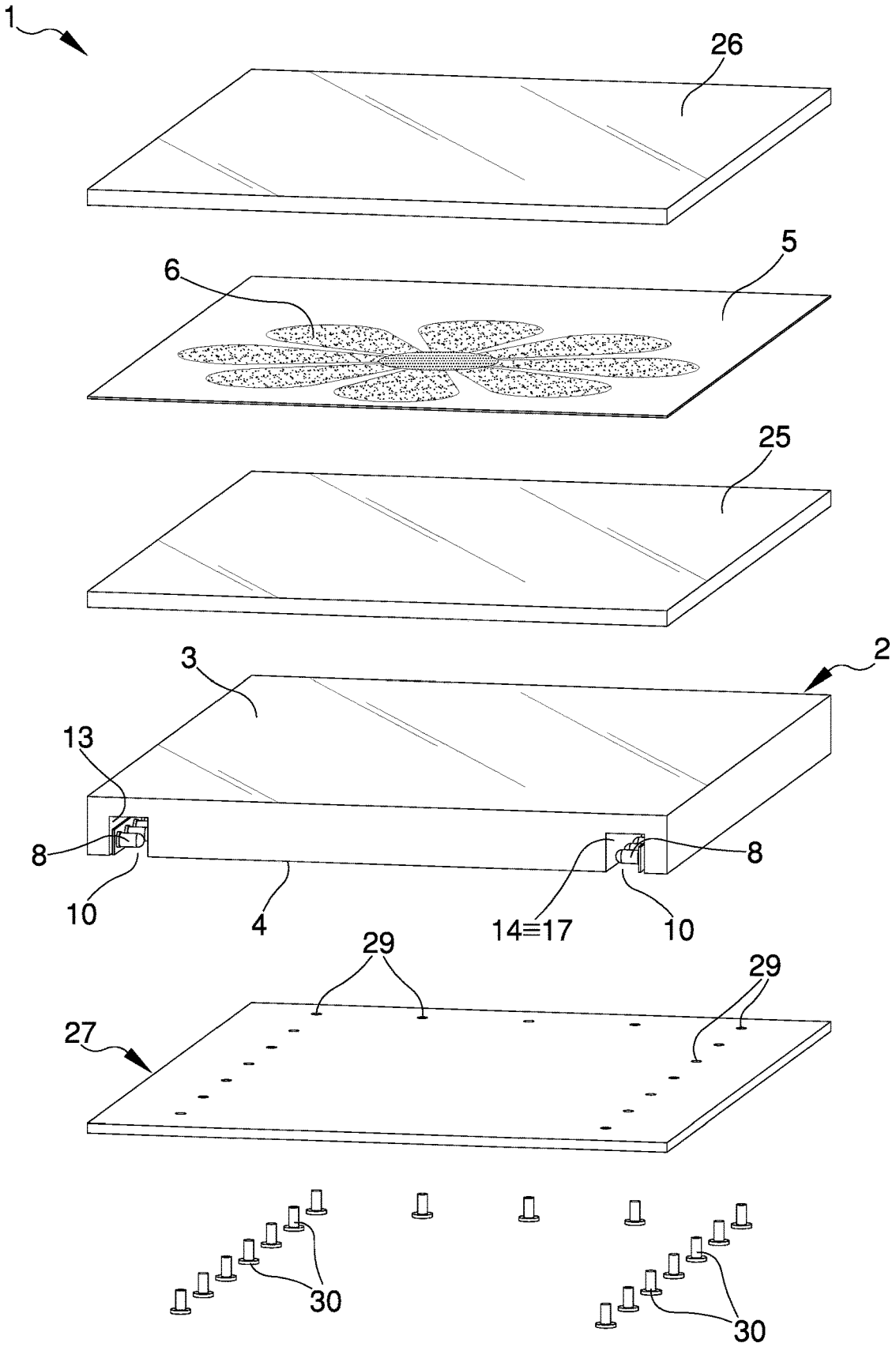
FIG. 3 is an exploded section of the illuminated decorative panel of FIG. 1.

With particular reference to these illustrations, reference numeral 1 globally designates an illuminated decorative panel.

The illuminated decorative panel 1 comprises at least one slab 2 made up at least partly of a substantially transparent material.

Advantageously, the substantially transparent material is of the polymeric type. Preferably, the polymeric material of which the slab 2 is made is Plexiglas.

Alternative embodiments cannot however be ruled out wherein the substantially transparent material of which the slab 2 is made is of a different nature; for example, the slab 2 can be made partly or entirely of glass.

Conveniently, the slab 2 comprises at least a first face 3 and at least a second face 4 opposed the first face 3.

In the particular embodiment shown in the figures, the first face 3 and the second face 4 are substantially rectangular in shape.

Alternative embodiments cannot however be ruled out wherein the first face 3 and the second face 4 have different conformation, e.g. square shape or with a curved profile.

The illuminated decorative panel 1 comprises at least one decorative element 5 associated with the slab 2.

Specifically, the decorative element 5 is associated with the slab 2 at the first face 3 and comprises ornamental elements of the slab 2 that can be of a different type, e.g. images.

Preferably, the decorative element 5 comprises at least one sheet 5 associated with the slab 2.

The sheet 5 is substantially a coating element which partly covers the slab 2 and a decoration 6 is applied thereon.

For example, the sheet 5 may consist of a sheet of pre-printed paper material.

In the particular embodiment shown in the figures, the sheet 5 has a substantially rectangular shape and covers the entire surface of the first face 3 of the sheet 2.

Alternative embodiments in which the decorative element 5 has a different nature cannot however be ruled out; for example, the decorative element 5 may comprise decorations applied directly onto the surface of the slab 2.

The aforementioned decorations can, e.g., be obtained by applying appropriate paints and/or glazes on the slab 2 to reproduce a pre-established pattern or special aesthetic effects.

The illuminated decorative panel 1 comprises lighting means 7 of the slab 2.

According to the invention, the lighting means 7 comprise at least one emitting device 8 of at least one light wave 9.

The light wave 9 passes through the slab 2 by moving from the emitting device 8 towards the first face 3 and thus illuminating the decorative element 5.

This way the decorative element 5 is made visible from an outer position relative to the slab 2.

Conveniently, the illuminated decorative panel 1 comprises a plurality of emitting devices 8.

Preferably, these emitting devices 8 are arranged side by side and are equidistant from each other.

Advantageously, at least one of the emitting devices 8 is of the LED type.

In the particular embodiment shown in the figures, the emitting devices 8 are all of the LED type.

Alternative embodiments cannot however be ruled out wherein there is only one emitting device 8 of the LED type or of another type.

Furthermore, we also consider the case in which there is a plurality of emitting devices 8, only some of them being of the LED type and the others being of a different type.

Advantageously, according to the invention, the slab 2 comprises at least one housing compartment 10 of the emitting devices 8.

The housing compartment 10 is formed along at least one stretch of at least one side of the slab 2.

Preferably, the housing compartment 10 extends along the whole side of the slab 2.

Preferably, the housing compartment 10 extends along a straight and parallel direction to the respective side of the slab 2.

Different positions and shapes of the housing compartment 10 cannot however be ruled out.

In the particular embodiment shown in the figures, there is a plurality of housing compartments 10, in particular two.

Specifically, one of the two housing compartments 10 is formed along a first side 11 of the slab 2, the other housing compartment 10 is located along a second side 12 of the slab 2.

The first side 11 and the second side 12 are parallel to each other and are positioned opposite the geometric centre of the slab 2.

According to a possible embodiment shown in the figures, the housing compartments 10 are made up of grooves formed on the slab 2 and each comprises a mutually opposite first wall 13 and second wall 14.

In particular, each housing compartment 10 has a substantially rectangular cross section.

Alternative embodiments cannot however be ruled out wherein there is a different number of housing compartments 10 with different conformations.

Each housing compartment 10 comprises an access opening 15 from the outside, formed on the second face 4.

The emitting devices 8 are conveniently housed inside the housing compartment 10 directed in such a way that the light wave 9 crosses the slab 2 from one side of the slab 2 towards an opposite side of the slab 2.

More precisely, the emitting devices 8 are associated with the first wall 13 so as to face the second wall 14.

This way, the light wave 9 spreads towards the second walls 14 and passes through these.

In the particular embodiment shown in the figures, the emitting devices 8 accommodated in each housing compartment 10 are arranged to form a row 16 which extends along the housing compartment 10 itself in a substantially parallel direction to the first side 11 and to the second side 12.

Different embodiments however are also provided wherein the emitting devices 8 are allocated differently inside the housing compartments 10; for example, they can be arranged in a random order.

The housing compartments 10 usefully comprise at least one polished surface 17 adapted to be crossed by the light wave 9.

According to the embodiment shown in the figures, the polished surface 17 coincides with the second wall 14.

Advantageously, the illuminated decorative panel 1 comprises electrical connection means 18 of the emitting devices 8.

The electrical connection means 18 comprise a plurality of electrical cables and allow the electrical connection between the emitting devices 8 and an external supply unit.

This way it is possible to switch on the emitting devices 8 during the operation of the illuminated decorative panel 1.

Advantageously, the slab 2 comprises at least one containment compartment 19 of the electrical connection means 18.

The containment compartment 19 is formed onto at least one stretch of at least one side of the slab 2. Different positions of the containment compartment 19 cannot however be ruled out.

In the particular embodiment shown in the figures, the containment compartment 19 is made along a stretch of a third side 20 of the slab 2.

The third side 20 is positioned transversely to the first side 11 and to the second side 12.

The containment compartment 19 is made up of a groove formed directly on the slab 2 which runs along a straight direction at the point where the third side 20 is located.

According to a possible embodiment, illustrated in the figures, the containment compartment 19 has a substantially rectangular cross section.

The containment compartment 19 has the ends arranged at the point where the housing compartments 10 are located and comprises a third wall 21 that separates the containment compartment 19 from the housing compartments 10.

The containment compartment 19 comprises an inlet opening 22 to the containment compartment 19 itself, formed on the second face 4.

Alternative embodiments cannot however be ruled out wherein the containment compartment 19 is positioned differently from the housing compartment 10 and wherein it has a different conformation.

There are also embodiments wherein there is a plurality of containment compartments 19.

The electrical connection means 18 are inserted inside the containment compartment 19 passing through the inlet opening 22.

The containment compartment 19 conveniently comprises first connection means 23 adapted to facilitate the connection between the emitting devices 8 and the electrical connection means 18.

Advantageously, the containment compartment 19 comprises second connection means 24 adapted to facilitate the connection between the electrical connection means 18 and an external supply unit.

In the particular embodiment shown in the figures, the first connection means 23 comprise two holes 23 made on the third wall 21 and placed at the point where the housing compartments 10 are located.

Specifically, one of the holes 23 is positioned at the point where one of the housing compartments 10 is located, while the other hole 23 is positioned at the point where the other housing compartment 10 is located.

Alternative embodiments cannot however be ruled out wherein the first connection means 23 are different in shape; for example, only one hole 23 or more than two holes 23 may be provided.

The electrical connection means 18 located in the containment compartment 19 are adapted to pass through the holes 23 and are connected to each emitting device 8.

The second connection means 24 comprise an outlet hole 24 of the electrical connection means 18.

The outlet hole 24 is positioned inside the containment compartment 19 and at the point where the second rear face-2 of the slab 2 is located, and is crossed by the electrical connection means 18 which are then connected to an external supply unit.

Advantageously, this allows having an even distribution of light along the entire profile of the illuminated decorative panel 1.

Conveniently, the illuminated decorative panel 1 comprises diffusion means 25 of the light wave 9 from the first face 3 outwards, the diffusion means 25 being associated with the slab 2.

The light wave 9 reaches the first face 3 and passes through the diffusion means 25; this way the light wave 9 radiates outwards and spreads evenly to the edges.

Advantageously, this allows having an even distribution of light even when several illuminated decorative panels are used side by side, thus eliminating the presence of shadow areas along the edges and at the points of contact between the panels.

In particular, the diffusion means 25 comprise at least one diffuser element 25 associated with the first face 3 and with the decorative element 5.

The diffuser element 25 comprises a first face which is associated with the first face 3 of the slab 2 so that the first face of the diffuser element 25 and the first face 3 of the slab 2 are perfectly matching.

The diffuser element 25 conveniently extends over the entire surface of the first face 3 of the slab 2.

The diffuser element 25 comprises a second face opposite the first face of the diffuser element 25 with which the decorative element 5 is associated.

Advantageously, the illuminated decorative panel 1 comprises protection means 26 associated with the slab 2.

In particular, the protection means 26 comprise at least one protection slab 26 associated with the decorative element 5.

The protection slab 26 is associated with the decorative element 5 so that they are perfectly matching.

The protection slab 26 is adapted to prevent any harmful external agents from contacting and/or damaging the decorative element 5.

The protection slab 26 is made up of substantially transparent polymeric material that allows the visibility of the decorative element 5 from the outside.

Advantageously, the illuminated decorative panel 1 comprises at least one covering panel 27 of the second face 4.

The covering panel 27 is substantially a cover associated with the second face 4.

The covering panel 27 is adapted to close both the access opening 15 to the housing compartment 10 and the inlet opening 22 to the containment compartment 19.

This way, the emitting devices 8 and the electrical connection means 18 are not contacted by any harmful elements such as dust or humidity that may affect the operation thereof.

At the same time, the covering panel 27 is adapted to partly prevent the light wave 9 from propagating outwards starting from the second face 4.

Advantageously, the slab 2 comprises fastening means 28 of the covering panel 27.

The fastening means 28 are comprised in the second face 4.

In particular, the fastening means 28 comprise at least one threaded bush 28 formed on the second face 4.

In the particular embodiment shown in the figures there is a plurality of threaded bushes 28 arranged in the proximity of the outer edge of the second face 4.

The covering panel 27 comprises a plurality of through holes 29 located on the outer edge of the covering panel 27.

The illuminated decorative panel 1 conveniently comprises a plurality of threaded bars 30 which are adapted to pass through the through holes 29 and to insert inside the threaded bushes 28 to allow the fixing of the covering panel 27 to the second face 4.

FIG. 4 shows a second embodiment of the illuminated decorative panel 1, wherein the components identical to the first embodiment have the same reference numerals as the first embodiment, the full description of which is given in detail.

The second embodiment differs from the first embodiment by the fact that the illuminated decorative panel 1 comprises diffusion means 25 comprising two diffuser elements 25, identical to each other, associated with the first face 3 and with the second face 4 of the slab 2, respectively.

Furthermore, the illuminated decorative panel 1 made according to the second embodiment comprises:

- two decorative elements 5 which are associated with the two diffuser elements 25, respectively; and
- protection means 26 comprising two protection slabs 26 associated with the two decorative elements 5, respectively.

The illuminated decorative panel 1 in FIG. 4 does not comprise the covering panel 27 on the second face 4.

In practice, the illuminated decorative panel 1 of FIG. 4 comprises two decorative elements 5, one visible from the first face 3 and the other visible from the second face 4.

The illuminated decorative panel 1 made according to the second embodiment can be used, e.g., as a separating element between adjacent rooms.

FIG. 5 shows a further possible embodiment wherein the illuminated decorative panel 1 has a rounded profile conformation.

In this case, the housing compartment 10 of the lighting means 7 extends along a curved trajectory along the edge of the slab 2 of the decorative panel 1.

Advantageously, therefore, the illuminated decorative panel 1 can be shaped in various ways in order to obtain different illuminated decorative elements, such as wall lamps or the like.

Figure 6:
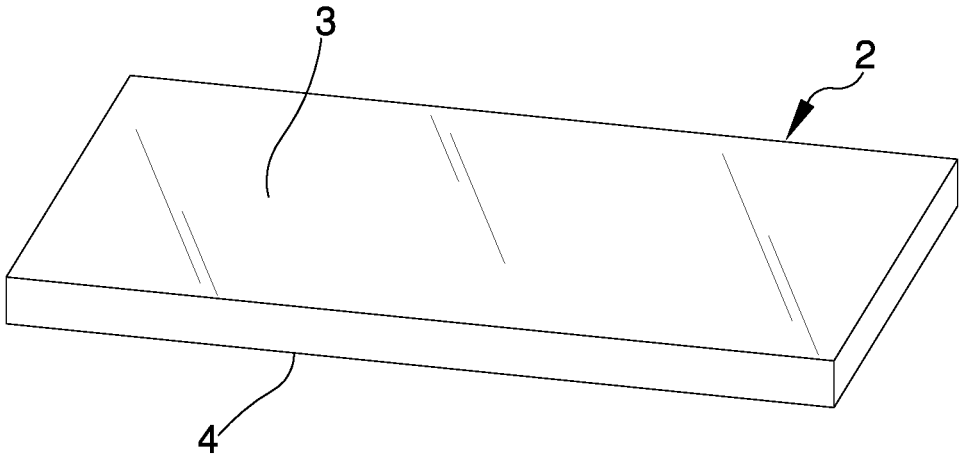
Figure 7:
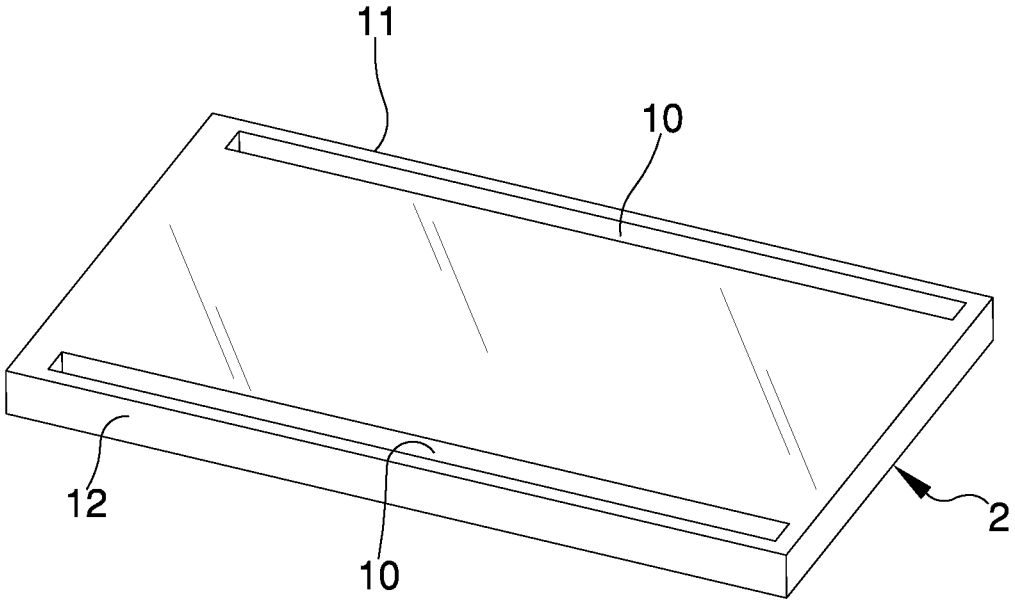
Figure 8:
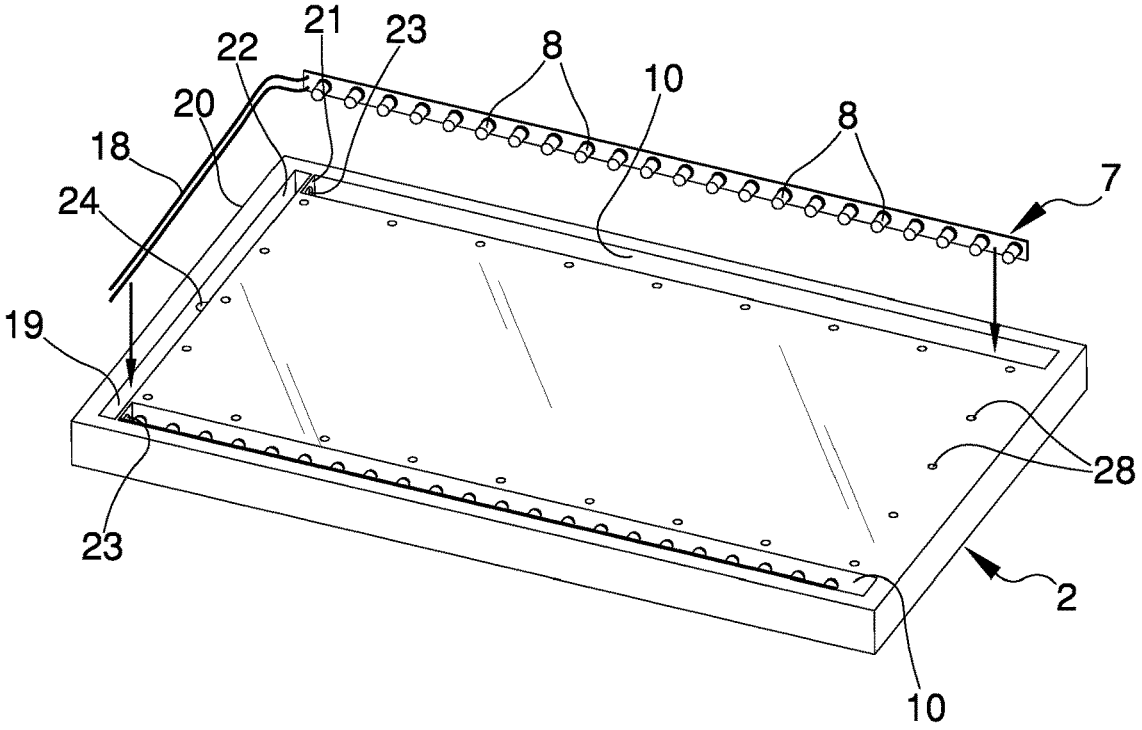
Figure 9:
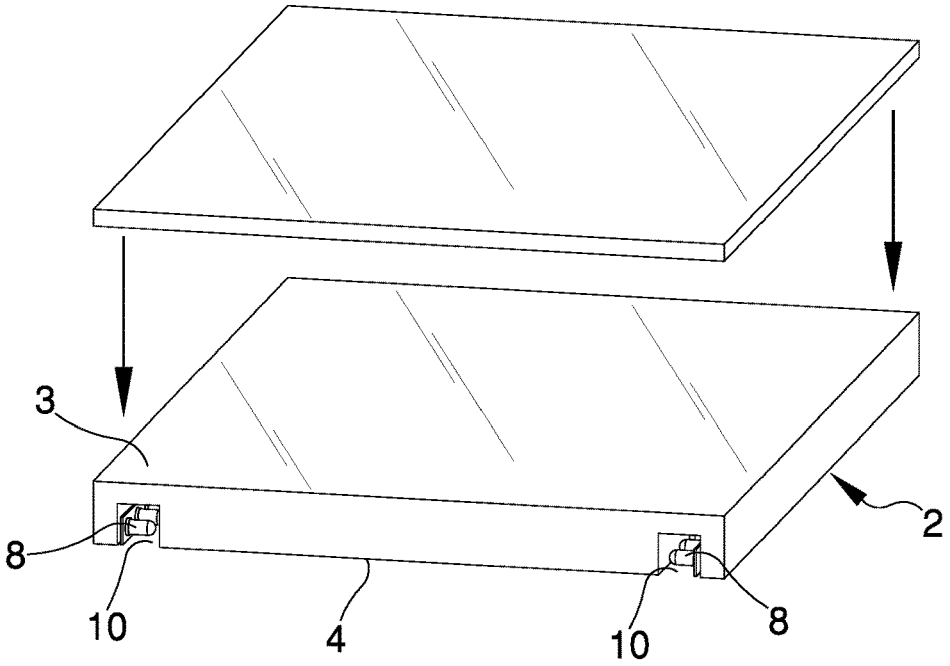

The process for manufacturing an illuminated decorative panel 1 according to the invention is schematically illustrated in FIGS. 6 to 12 and comprises at least the steps of:

- providing at least one slab 2 made at least partly of a substantially transparent material and comprising at least a first face 3 and at least a second face 4 opposite the first face 3;
- providing at least one decorative element 5 of the slab 2;
- providing at least one emitting device 8 of at least one light wave 9 adapted to illuminate the slab 2;
- providing electrical connection means 18 of the emitting device 8.

In the particular embodiment shown in the figures, the decorative element 5 comprises at least one sheet 5 having a substantially slab-like shape.

Further, in the particular embodiment shown in FIGS. 6 to 12 the phase of providing at least one emitting device 8 comprises the step of providing a plurality of emitting devices 8.

Furthermore, the emitting devices 8 are of the LED type.

The process for manufacturing an illuminated decorative panel 1 according to the invention comprises at least the phase of partly removing the substantially transparent material at at least one stretch of at least one side of the slab 2 to obtain at least one housing compartment 10 of the emitting devices 8.

In the particular embodiment shown in FIGS. 6 to 12, the substantially transparent material is removed along a stretch of a first side 11 of the slab 2 and along a stretch of a second side 12 of the slab 2.

This way two substantially hollow portions are obtained that make up two housing compartments 10, having a substantially rectangular cross section and each comprising a first wall 13 and a second wall 14 which are mutually opposite.

The process according to the invention comprises at least the phase of fixing the emitting devices 8 inside the housing compartments 10 directed in such a way that the light wave 9 crosses the slab 2 from one side of the slab 2 to an opposite side of the slab 2.

More precisely, the emitting devices 8 are fixed to the first walls 13 of each housing compartment 10 and face the second walls 14 of the housing compartment 10 itself.

Usefully, the process according to the invention comprises, prior to the phase of fixing the emitting devices 8, at least the phase of polishing at least one polished surface 17 of each housing compartment 10.

The polished surface 17 is adapted to be crossed by the light wave 9.

In the particular embodiment shown in the figures, the polished surface 17 of each housing compartment coincides with the second wall 14 of the relevant housing compartment 10.

The polished surface 17 is smoothed so as to make it more transparent.

This way it is possible to reduce any reflection phenomena of the light wave 9 by the second walls 14, which are thus crossed more easily by the light wave 9 itself.

The process according to the invention comprises the phase of fixing the decorative element 5 to the slab 2.

Advantageously, the phase of fixing the decorative element 5 to the slab 2 comprises at least the steps of:

- providing diffusion means 25 of the light wave 9 from the first face 3 outwards comprising at least one diffuser element 25;
- providing protection means 26 comprising at least one protection slab 26;
- fixing the diffuser element 25 to the first face 3;
- fixing the decorative element 5 to the diffuser element 25;
- fixing the protection slab 26 to the decorative element 5.

The diffuser element 25 comprises a first face, which is positioned and fixed on the first face 3 of the slab 2, and a second face on which the decorative element 5 is positioned and fixed.

The protection slab 26 is then positioned and fixed onto the decorative element 5.

Subsequently, the process according to the invention comprises the phase of connecting the emitting devices 8 to the electrical connection means 18.

The electrical connection means 18 comprise, in the particular embodiment shown in the figures, a plurality of electrical cables which are adapted to allow the electrical connection between the emitting devices 8 and an external supply unit of the same.

Prior to the phase of connecting the emitting devices 8 to the electrical connection means 18 the process according to the invention comprises at least the steps of:

- partly removing the substantially transparent material from at least one stretch of at least one side of the slab 2 to obtain at least one containment compartment 19 of the electrical connection means 18;
- positioning the electrical connection means 18 inside the containment compartment 19.

In the particular embodiment shown in the figures, the containment compartment 19 is made by removing the substantially transparent material from one portion of the slab 2 that extends along a third side 20.

The third side 20 is positioned transversely to the first side 11 and to the second side 12.

The containment compartment 19 comprises a third wall 21 that separates the containment compartment 19 from the housing compartments 10.

The step of partly removing the substantially transparent material to obtain the containment compartment 19 conveniently comprises the sub-steps of:

partly removing the substantially transparent material from the third wall 21 to obtain the first connection means 23; and partly removing the substantially transparent material from the wall opposite the third wall 21 to obtain second connection means 24.

In the particular embodiment shown in the figures, the first connection means 23 comprise two holes 23, positioned at the point where the housing compartments 10 are located.

More precisely, a hole 23 is formed at the point where a housing compartment 10 is located, the other hole 23 is formed at the point where the other housing compartment 10 is located.

Furthermore, the second connection means 24 comprise an outlet hole 24.

Subsequently, the electrical connection means 18 are positioned inside the containment compartment 19 and are made to pass through the holes 23 and, at the same time, through the outlet hole 24.

Then, the emitting devices 8 are connected to the electrical connection means 18.

Advantageously, the process according to the invention, after the phase of connecting the emitting devices 8 to the electrical connection means 18, comprises at least the steps of:

providing at least one covering panel 27 of the second face 4;

obtaining fastening means 28 of the covering panel 27 on the second face 4;

fixing the covering panel 27 to the fastening means 28.

In the particular embodiment shown in the figures, the fastening means 28 comprise a plurality of threaded bushes 28.

In this regard, the step of obtaining the fastening means 28 on the second face 4 comprises the step of partly removing the substantially transparent material located in the proximity of the outer edge of the second face 4 to obtain the threaded bushes 28.

Conveniently, the covering panel 27 is substantially a cover comprising a plurality of through holes 29 that are crossed by threaded bars 30 that fit into the threaded bushes 28 during the phase of fixing the covering panel 27 to the fastening means 28.

The operation of the illuminated decorative panel according to the invention is substantially the following.

The emitting devices 8, after connecting to an external supply unit through the electrical connection means 18, emit a light wave 9 which crosses the second wall 14 and reaches the first face 3.

The light wave 9 then crosses the diffuser element 25 and is diffused in different directions thanks to the diffuser element 25.

The light wave 9 crosses the decorative element 5 which is illuminated in a substantially even manner and made visible by an observer located outside the illuminated decorative panel 1.

It has in practice been found that the described invention achieves the intended objects.

In particular, the fact is underlined that the housing compartment formed in the slab allows significantly reducing the overall dimensions of the illuminated decorative panel.

Specifically, the fact that the housing compartment is formed inside the slab allows avoiding that the housing compartment protrudes from the slab, thus reducing the overall dimensions of the illuminated decorative panel.

In addition, it should be noted that there are no assembly phases of the housing compartment to the slab, thus reducing the time required for the manufacturing of the illuminated decorative panel.

Furthermore, the presence of a housing compartment formed inside the slab allows reducing the infiltration of dust and/or humidity and/or other harmful elements that can damage the illuminated decorative panel.

The invention claimed is:

1. An illuminated decorative panel comprising:

at least one slab composed at least partly of substantially transparent material;

at least one decorative element associated with said slab;

lighting means of said slab, wherein said lighting means comprise at least one emitting device of at least one light wave;

said slab comprises at least one housing compartment of said emitting device, said housing compartment being formed along at least one stretch of at least one side of said slab, wherein said slab comprises at least a first face and at least a second face opposed said first face; and a fastening means comprise at least one threaded bush obtained on said second face.

2. The illuminated decorative panel according to claim 1, wherein said emitting device is housed inside said housing compartment directed so that said light wave crosses said slab from one side of said slab towards an opposite side of said slab.

3. The illuminated decorative panel according to claim 1, wherein said housing compartment comprises at least one polished surface adapted to be crossed by said light wave.

4. The illuminated decorative panel according to claim 1, further comprising: a plurality of said emitting devices.

5. The illuminated decorative panel according to claim 1, wherein at least one of said emitting devices is of the LED type.

6. The illuminated decorative panel according to claim 1, wherein said substantially transparent material is of the polymeric type.

7. The illuminated decorative panel according to claim 1, wherein said decorative element comprises at least one sheet associated with said slab.

8. The illuminated decorative panel according to claim 1, further comprising: electrical connection means of said emitting devices.

9. The illuminated decorative panel according to claim 1, wherein said slab comprises at least one containment compartment of said electrical connection means, said containment compartment being formed on at least one stretch of at least one side of said slab.

10. The illuminated decorative panel according to claim 9, wherein said containment compartment comprises:

first connection means adapted to facilitate the connection between said emitting devices and said electrical connection means; and second connection means adapted to facilitate the connection between said electrical connection means and an external supply unit.

11. The illuminated decorative panel according to claim 1, further comprising: diffusion means of said light wave from said first face towards the outside, said diffusion means being associated with said slab.

12. The illuminated decorative panel according to claim 11, wherein said diffusion means comprise at least one diffuser element associated with said first face and with said decorative element.

13. The illuminated decorative panel according to claim 1, further comprising: protection means associated with said slab.

14. The illuminated decorative panel according to claim 13, wherein said protection means comprise at least one protection slab associated with said decorative element.

15. The illuminated decorative panel according to claim 1, further comprising: at least one covering panel of said second face.

16. The illuminated decorative panel according to claim 15, wherein said slab comprises fastening means of said covering panel, said fastening means being comprised in said second face.

17. A process for manufacturing an illuminated decorative panel, the process comprising:

providing at least one slab made at least partly of a substantially transparent material and comprising at least a first face and at least a second face opposed the first face;

providing at least one decorative element of said slab;

providing at least one emitting device of at least one light wave adapted to illuminate said slab;

providing electrical connection means of said emitting device;

partly removing said substantially transparent material at at least one stretch of at least one side of said slab to obtain at least one housing compartment of said emitting device;

fixing said emitting device inside said housing compartment directed so that said light wave crosses said slab from one side of said slab to an opposite side of said slab;

fixing said decorative element to said slab;

connecting said emitting device to said electrical connection means, wherein said slab comprises at least a first face and at least a second face opposed said first face; and providing a fastening means that comprise at least one threaded bush obtained on said second face.

18. The process according to claim 17, wherein said process further comprises, prior to said fixing said emitting device: polishing at least one polished surface of said housing compartment, wherein said polished surface being adapted to be crossed by said light wave.

19. The process according to claim 17, wherein said fixing said decorative element to said slab further comprises:

providing diffusion means of said light wave from said first face towards the outside comprising at least one diffuser element;

providing protection means comprising at least one protection slab;

fixing said diffuser element to said first face;

fixing said decorative element to said diffuser element; and fixing said protection slab to said decorative element.

20. The process according to claim 17, wherein prior to said connecting said emitting device to said electrical connection means, further comprises:

partly removing said substantially transparent material from at least one stretch of at least one side of said slab to obtain at least one containment compartment of said electrical connection means; and positioning said electrical connection means inside said containment compartment.

21. The process according to claim 17 further comprising, after said connecting said emitting devices to said electrical connection means:

providing at least one covering panel of said second face;

obtaining fastening means of said covering panel on said second face; and fixing said covering panel to said fastening means.

* * * * *